US006019336A

United States Patent [19]

Havens

[11] Patent Number: 6,019,336

[45] Date of Patent: Feb. 1, 2000

[54] CORNER CUSHION

[75] Inventor: Lamar D. Havens, Seattle, Wash.

[73] Assignee: Mantec Services Company, Seattle, Wash.

[21] Appl. No.: 08/937,539

[22] Filed: Sep. 25, 1997

[51] Int. Cl.[7] ..... A47B 95/00

[52] U.S. Cl. ..... 248/345.1; 248/205.3

[58] Field of Search ..... 248/205.3, 345.1

[56] References Cited

U.S. PATENT DOCUMENTS

| | | | |
|---|---|---|---|
| 2,166,798 | 7/1939 | Cote | 248/345.1 |
| 4,109,887 | 8/1978 | Wakeland, Jr. | 248/345.1 |
| 4,582,739 | 4/1986 | Givens | 248/345.1 |
| 4,883,281 | 11/1989 | Waterman | 248/345.1 |
| 4,903,686 | 2/1990 | Jennings | 248/345.1 X |
| 5,170,971 | 12/1992 | Schaeffer et al. | 248/345.1 X |
| 5,208,084 | 5/1993 | Rutz | 248/345.1 |
| 5,271,662 | 12/1993 | Saul | 248/345.1 |
| 5,308,253 | 5/1994 | Maki | 248/205.3 X |
| 5,508,078 | 4/1996 | Stalnaker | 248/345.1 X |
| 5,639,072 | 6/1997 | McCall | 248/345.1 X |

FOREIGN PATENT DOCUMENTS

| | | | |
|---|---|---|---|
| 885140 | 7/1949 | Germany | 248/345.1 |

*Primary Examiner*—Ramon O. Ramirez
*Assistant Examiner*—Debbie Short
*Attorney, Agent, or Firm*—Christensen O'Connor Johnson & Kindness PLLC

[57] ABSTRACT

A cushion (10) for attachment to an edge (14, 16) of a work surface (12) supports the forearms or wrists of a person working at the work surface. The cushion includes an elongate cushioning foam member that has a notch defined by a generally rectangular first mating surface (18) and a generally rectangular second mating surface (24) for attaching the cushion to the surface of the workstation. The first mating surface and the second mating surface intersect such that they are substantially normal to each other. A first padding portion (32) overlies the first mating, surface. The first padding portion has a thickness that is maximized near a point (A) that is coplanar with the second mating surface and that tapers to a minimized thickness at an outer edge (22) of the first mating surface. A second padding portion (34) overlies the second mating surface. The second padding portion has a thickness that is maximized near a point (B) that is coplanar with the first mating surface and that tapers to a minimized thickness at an outer edge (28) of the second mating surface. A skin (38) is disposed around the first and second padding portions.

15 Claims, 1 Drawing Sheet

CORNER CUSHION

FIELD OF THE INVENTION

The present invention relates to an ergonomic cushion and, more particularly, to a corner cushion for a desk or a workstation.

BACKGROUND OF THE INVENTION

People who work for extended periods of time at desks or workstations with hard edges or corners can experience fatigue or injuries to the forearm or wrist due to inadequate support for their arms and upper body. This lack of support can also result in a repetitive stress injury, such as tendonitis or carpal tunnel syndrome, when repetitive tasks, such as typing, are performed.

To alleviate such injuries, it would be desirable to cushion the edge of a desk or a workstation. While it is known to attach relatively hard, nonfoamed extrusions to furniture with various metal retaining devices, these devices are intended to, protect the furniture rather than the user. Other attempts to soften hard corners have included rounding or shaping the corner to remove sharp edges, such as 90° intersections It is also known to use extruded polyethylene foam packaging to protect the corners of a product. Polyethylene foam does not have the resiliency of urethanes, rubbers and some other thermoplastic elastomers. Further, polyethylene foam damages easily, is not durable, and is not sufficiently flexible. Furthermore, extruded polyethylene foam is not aesthetically suitable for a professional office environment and is difficult to decorate.

Given the shortcomings in the prior art, there is an unmet need for a corner cushion that is easily attached to a desk or a workstation, is flexible, and is aesthetically suitable for a professional office environment.

SUMMARY OF THE INVENTION

The present invention is a corner cushion that provides support for the forearms or wrists of a worker at a desk or a workstation, and is durable, flexible, and aesthetically suitable for a professional office environment.

The cushion includes an elongate cushioning foam member that has a notch defined by a generally rectangular first mating surface and a generally rectangular second mating surface for attaching the cushion to the surface of the workstation. The first mating surface and the second mating surface intersect and form a 90° angle. A first padding portion overlies the first mating surface. The first padding portion has a thickness that is maximized near a point that is coplanar with the second mating surface and that tapers to a minimized thickness at an outer edge of the first mating surface. A second padding portion overlies the second mating surface. The second padding portion has a thickness that is maximized near a point that is coplanar with the first mating surface and that tapers to a minimized thickness at an outer edge of the second mating surface. A skin is disposed around the first and second padding portions of the cushion to enhance its aesthetics.

According to an aspect of the present invention, the thickness of the first and second padding portions tapers along a constantly increasing radius from the intersection of the first and second mating surfaces. This tapering minimizes the height of the corner cushion while still providing support for the forearms and upper body of the user. A low profile does not interfere with use of the table surface adjacent the cushion. Further, reducing the height of the cushion permits the corner cushion of the present invention to be aesthetically suited to a professional office environment as well as to an industrial workstation environment.

According to another aspect of the present invention, the user can tailor the support provided by the corner cushion to the needs of the user, as desired, by simply selecting which of the first or second mating surfaces is to be attached to the work surface of the workstation. The first mating surface is wider than the second mating surface such that the corner cushion supports the forearms of the user when the first mating surface is attached to the work surface, and the corner cushion supports the wrists of the user when the second mating surface is attached to the work surface.

According to a further aspect of the present invention, an adhesive, such as double-backed tape, is provided on the first and second mating surfaces. The double-backed tape has a first tack level on a first side of the tape and a second tack level, which is less than the first tack level, on a second side of the tape. The double-backed tape permits the corner cushion to be removably attached to a desk or a workstation surface. The first tack level ensures that the tape remains attached to the first and second mating surfaces of the elongate member. The second tack level holds the corner cushion in place on the workstation, but allows the corner cushion to be removed with the double-backed tape adhering to the first and second mating surfaces as the corner cushion is being removed from the desk or workstation surface

BRIEF DESCRIPTION OF THE DRAWINGS

The foregoing aspects and many of the attendant advantages of this invention will become more rely appreciated by reference to the following detailed description, when taken in conjunction with the accompanying drawings, wherein.

DETAILED DESCRIPTION OF THE PREFERRED EMBODIMENT

Figures 1, 2:
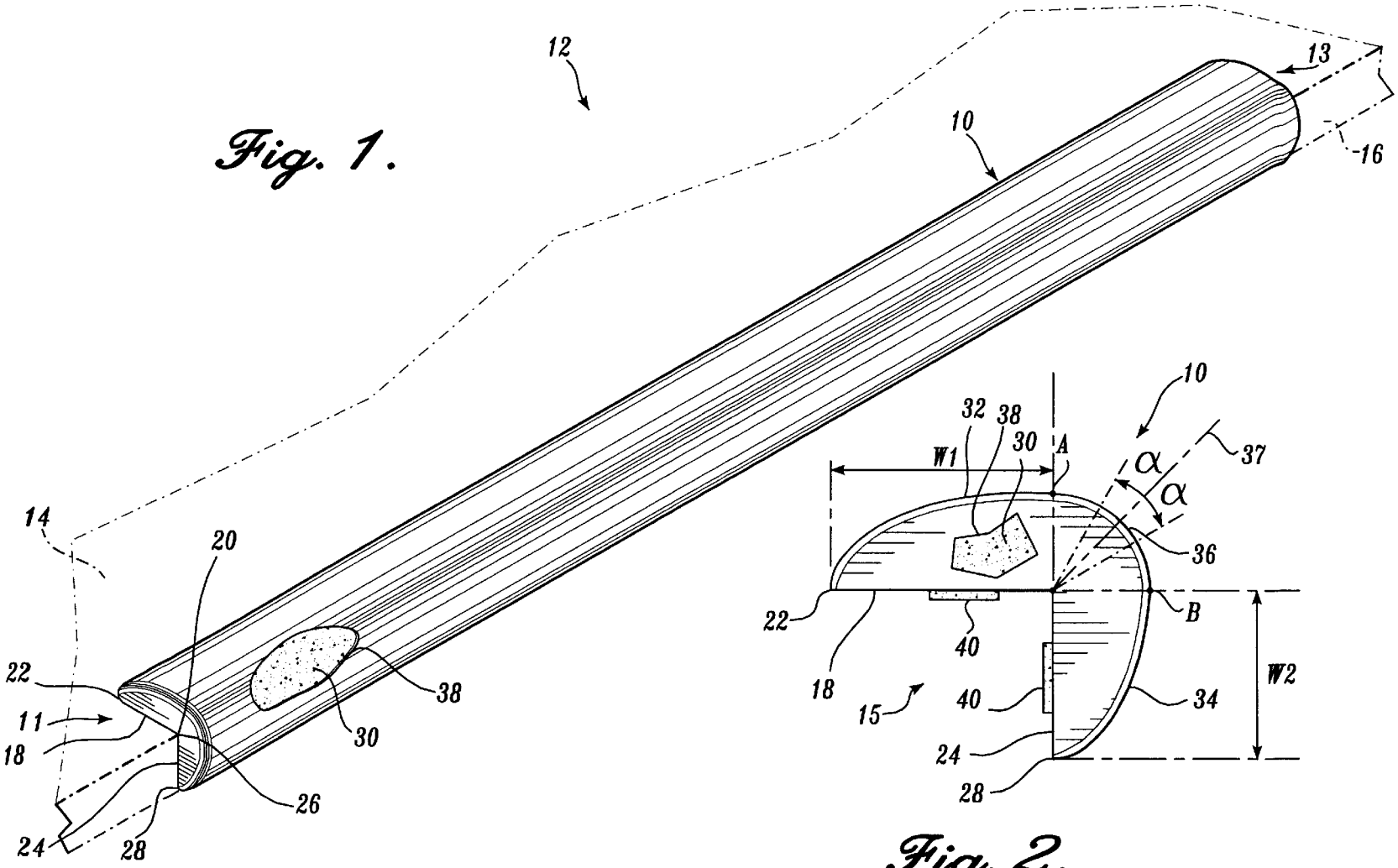
FIG. 1 is a perspective view of a corner cushion according to the present invention.
FIG. 2 is an end view of the corner cushion of FIG. 1.

As shown in FIG. 1, a desk or workstation 12 includes a top work surface 14 and a side surface 16. To protect the wrists and forearms of a user sitting at the desk or work station, the present invention is a corner cushion 10 that covers the edge where the top surface 14 of the workstation meets the side surface 16.

Referring now to FIGS. 1 and 2, the corner cushion 10 is an elongate, generally cylindrical member having a first end 11 and a second end 13. A generally L-shaped notch 15 is cut in the corner cushion 10 and extends from the first end 11 to the second end 13 so that the corner cushion 10 can be placed on the top surface 14 where the top work surface 14 meets the side surface 16. The notch 15 is defined by a generally flat first mating surface 18 and a generally flat second mating surface 24 that is perpendicular to the first mating surface 18. As will be discussed later, in one embodiment the first mating surface 18 is wider than the second mating surface 24. Thus, the first mating surface 18 is placed on the top work surface 14 so that the corner cushion 10 provides support for the forearms of the user working, at the workstation 12. Alternatively, the second mating surface 24 of the corner cushion may be placed on the top work surface 14 so that the corner cushion 10 provides support for the wrists of the user working at the workstation 12.

The corner cushion 10 includes a foam core 30 that is covered on its outer surface by a skin 38. The skin 38 can be provided with an appearance that is suitable for a professional office environment, such as a leather-grained surface, or any other surface as desired that is suitable for industrial or factory workstation settings. In a presently preferred embodiment, the foam is a flexible foam material, such as polyurethane foam. The flexibility afforded by polyurethane foam permits the corner cushion 10 to be used on nonstraight work surfaces, such as the surfaces of round tables. The skin 38 is suitably a flexible material, such as urethane elastomer, polyvinyl chloride (vinyl), or any one of several thermoplastic elastoiners that provides resistance to cuts and normal wear and tear. However, it will be appreciated that other materials could also be used in other preferred embodiments. For example, the foam core 30 is suitably an extruded synthetic rubber, such as, without limitation, neoprene. In this case, the skin 38 is wrapped and bonded onto the extruded synthetic rubber. The corner cushion 10 is cut to a desirable length, and the first end 11 and the second end 13 are closed with a soft end cap. It will be appreciated that fabricating the corner cushion 10 with extruded synthetic rubber costs less than fabricating individual corner cushions 10 with polyurethane foam.

In a presently preferred embodiment, a first padding portion 32 of the cushion 10 overlies the first mating surface 18 and a second padding portion 34 of the cushion 10 overlies the second mating surface 24. The first padding portion has a thickness that is maximized near a point A that is coplanar with the second mating surface 24. The thickness of the first padding portion 32 tapers to a minimized thickness at an edge 22 that is distal the second mating surface 24. The second padding portion has a thickness that is maximized near a point B that is coplanar with the first mating surface 18. The thickness of the second padding portion 34 tapers to a minimized thickness at an edge 28 that is distal the first mating surface 18. The thicknesses of the first and second padding portions 32 and 34 preferably taper from their maximum thicknesses near the points A and B, respectively, along constantly increasing radii as measured from the intersection of the first and second mating surfaces 18 and 24, respectively. This tapering allows the corner cushion 10 to cushion the forearms or wrists of the worker at the workstation 12 while providing a profile that is suitable for a professional office environment.

In one embodiment, the first mating surface suitably has a first width $w_1$ such that, when the first mating surface 18 is attached to the top work surface 14, the corner cushion 10 supports the forearms of the user. The second padding portion 34 has a second width $w_2$ such that, when the second mating surface 24 is attached to the top work surface 14, the corner cushion 10 supports the wrists of the user. This orientation would be desirable, for example, when the worker is performing repetitive tasks, such as typing at a keyboard that is placed on the top work surface 14 adjacent the corner cushion 10. In a presently preferred embodiment, the width $w_1$ of the first mating surface 18 is wider than the width $w_2$ of the second mating surface 24. Thus, the user can tailor the support provided by the corner cushion 10 to the user's needs, as determined by the work being performed, by simply selecting which of the first or second mating surfaces 18 or 24 is to be attached to the top work surface 14 of the workstation 12. The thicknesses of the first and second padding portions 32 and 34 are preferably selected to minimize the height that the corner cushion 10 rises above the work surface 14 of the workstation while still providing support as desired for the forearms or wrists of the user.

The first and second padding portions 32 and 34 suitably adjoin each other. However, a ridge will form at the intersection of the first and second padding portions 32 and 34, when the thicknesses of the first and second padding portions taper along a constantly increasing radii from the intersection of the first and second mating surfaces 18 and 24. In order to provide a smooth transition between the first and second padding portions 32 and 34, the first and second padding portions 32 and 34 preferably are adjoined to a circular padding portion 36 that fills in the portion of the cushion 10 between the point of maximum thickness of the first padding portion 32 at point A and the second padding portion 34 at point B. The circular padding portion 36 has a substantially constant thickness along a radius R as measured from the intersection of the first and second mating surfaces 18 and 24. The circular padding portion 36 is suitably symmetrical about an axis 37 that bisects the planes of the first and second mating surfaces 18 and 24. The size of the circular padding portion 36 is determined by an angle $\alpha$ on both sides of the axis 37. The angle $\alpha$ suitably has any value, depending upon the application and the size of the corner cushion 10. For example, each angle $\alpha$ is suitably between 10° and 20°, and is preferably about 15° to avoid the formation of a ridge between the first and second padding portions 32 and 34. It will be appreciated that the axis 37 need not bisect the planes of the first and second mating surfaces 18 and 24. It will also be appreciated that the circular padding portion 36 may be defined by angles of different sizes on either side of the axis 37.

It will be appreciated that the corner cushion 10 may be define by other geometries. For example, the first and second padding portions 32 and 34 may define rectangular portions that overlie the first and second mating surfaces 18 and 24, respectively. As a further example, the first and second padding portions 32 and 34 may have thicknesses that taper along a constant radius from the intersection of the first and second mating surfaces 18 and 24. In this case, the padding of the corner cushion 10 would be provided by a continuous circular portion. However, a rectangular geometry would introduce steep edges, and a circular geometry would present a higher profile from the top work surface 14.

The first and second mating surfaces 18 and 24 are suitably provided with an adhesive, such as double-backed tape 40. The double-backed tape 40 has a first tack level on one side that is affixed to the first mating surface 18, or the second mating surface 24, or both the first and second mating surfaces 18 and 24. The other side of the double-backed tape 40 has a second tack level that is less than the first tack level and is affixed to the top work surface 14, or the side surface 16, or both the top work surface 14 and the side surface 16. The second tack level is sufficient to keep the corner cushion 10 in place on the workstation 12. When it is desired to remove the corner cushion 10 from the workstation 12, the second tack level permits the corner cushion 10 to be removed while the first tack level keeps the double-backed tape 40 attached to the first and second mating surfaces 18 and 24. The second tack level is suitably low enough to prevent marring of the top work surface 14 and the side surface 16.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A cushion for attachment to an edge of a work surface to support forearms or wrists of a person working at the work surface, the cushion comprising:

an elongate foam member having:

a generally planar first mating surface for attaching to the work surface;

a generally planar second mating surface for attaching to the work surface, the first and second mating surfaces being substantially normal to each other;

a first padding portion overlying the first mating surface, the first padding portion having a thickness that is maximized near a point that is coplanar with the second mating surface, the thickness of the first padding portion tapering to a minimized thickness at an outer edge of the first mating surface;

a second padding portion overlying the second mating surface, the second padding portion having a thickness that is maximized near a point that is coplanar with the first mating surface, the thickness of the second padding portion tapering to a minimized thickness; at an outer edge of the second mating surface, wherein the thicknesses of the first and second padding portions taper along constantly increasing radii from the intersection of the first and second mating surfaces;

a substantially constant radius circular padding portion disposed between the first and second padding portions; and a skin disposed around the first and second padding portions.

2. The cushion of claim 1, wherein the first mating surface is wider than the second mating surface.

3. The cushion of claim 1, wherein the circular padding portion is substantially symmetrical about an axis that bisects the planes of the first and second mating surfaces.

4. The cushion of claim 3, wherein the circular padding portion is defined by angles of about 15° on either side of the axis.

5. The cushion of claim 1, further comprising an adhesive disposed on the first mating surface.

6. The cushion of claim 5, further comprising an adhesive disposed on the second mating surface.

7. The cushion of claim 6, wherein the adhesive includes double-backed tape.

8. The cushion of claim 8, wherein the double-backed tape has a first tack level on a first side and a second tack level on a second side, the first tack level being greater than the second tack level.

9. The cushion of claim 8, wherein the first tack level is applied to the first and second mating surfaces.

10. A cushion for attachment to an edge of a work surface to support forearms or wrists of a person working at the work surface, the cushion comprising:

an elongate foam member having:

a generally planar first mating surface for attaching to the work surface;

a generally planar second mating surface for attaching to the work surface, the first and second mating surfaces being substantially normnal to each other;

a first padding portion overlying the first mating surface, the first padding portion having a thickness that is maximized near a point that is coplanar with the second mating surface, the thickness of the first padding portion tapering along a constantly increasing radius from the intersection of the first and second mating surfaces to a minimized thickness at an outer edge of the first mating surface;

a second padding portion overlying the second mating surface, the second padding portion having a thickness that is maximized near a point that is coplanar with the first mating surface, the thickness of the second padding portion tapering along a constantly increasing radius from the intersection of the first and second mating surfaces to a minimized thickness at an outer edge of the second mating surface;

a substantially constant radius circular padding portion disposed between the first and second padding portions;

double-backed adhesive tape affixed to the first and second mating surfaces, the double-backed adhesive tape having a first tack level on a first side and a second tack level on a second side, the first tack level being greater than the second tack level; and a skin disposed around the first and second padding portions.

11. The cushion of claim 10, wherein the first mating surface is wider than the second mating surface.

12. The cushion of claim 10, wherein the first tack level is applied to the first and second mating surfaces.

13. A cushion for attachment to an edge of a work surface to support forearms or wrists of a person working at the work surface, the cushion comprising:

an elongate foam member having:

a generally planar first mating surface for attaching to the work surface;

a generally planar second mating surface for attaching to the work surface, the first and second mating surfaces being substantially normal to each other, the first rating surface being wider than the second mating surface;

a first padding portion overlying the first mating surface, the first padding portion having a thickness that is maximized near a point that is coplanar with the second mating surface, the thickness of the first padding portion tapering along a constantly increasing radius from the intersection of the first and second mating surfaces to a minimized thickness at an outer edge of the first mating surface;

a second padding portion overlying the second mating surface, the second padding portion having a thickness that is maximized near a point that is coplanar with the first mating surface the thickness of the second padding portion tapering along a constantly increasing radius from the intersection of the first and second mating surfaces to a minimized thickness at an outer edge of the second mating surface;

a substantially constant radius circular padding portion disposed between the first and second padding portions; and a skin disposed around the first and second padding portions.

14. The cushion of claim 13, further comprising double-backed adhesive tape affixed to the first and second mating surfaces, the double-backed adhesive tape having a first tack level on a first side and a second tack level on a second side, the first tack level being greater than the second tack level.

15. The cushion of claim 14, wherein the first tack level is applied to the first and second mating surfaces.

* * * * *